US006930261B2

(12) United States Patent
Nakade

(10) Patent No.: US 6,930,261 B2
(45) Date of Patent: Aug. 16, 2005

(54) SWITCH FOR VEHICLE

(75) Inventor: Yoshiyuki Nakade, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/900,329

(22) Filed: Jul. 28, 2004

(65) Prior Publication Data

US 2005/0029081 A1 Feb. 10, 2005

(30) Foreign Application Priority Data

Aug. 5, 2003 (JP) ..... 2003-286659

(51) Int. Cl.[7] ..... H01H 13/10

(52) U.S. Cl. ..... 200/16 D; 200/16 DA; 200/532; 200/302.2

(58) Field of Search ..... 200/16 R–16 D, 200/61.41–61.44, 61.62, 61.73, 61.74, 61.76, 61.78, 61.81, 520, 536, 530–532, 302.1, 302.2

(56) References Cited

U.S. PATENT DOCUMENTS 5,836,442 A * 11/1998 Hirano ..... 200/284
5,898,142 A * 4/1999 Ohtaki et al. ..... 200/16 C
6,046,413 A * 4/2000 Simonis et al. ..... 200/11 EA
6,396,013 B1 * 5/2002 Kondo ..... 200/302.3
6,610,939 B2 * 8/2003 Watada ..... 200/16 D
6,630,636 B2 * 10/2003 Nakamura ..... 200/16 R

FOREIGN PATENT DOCUMENTS

JP 2003-132761 5/2003

* cited by examiner

*Primary Examiner*—Michael A. Friedhofer
(74) *Attorney, Agent, or Firm*—Wenderoth, Lind & Ponack, L.L.P.

(57) ABSTRACT

A vehicle switch is capable of properly switching on/off electrical connection between fixed contacts. The fixed contacts of the switch are oppositely disposed on a substrate so as to be parallel to a moving direction of a moveable piece. A barrier constituted by a dent or a projection is disposed between the fixed contacts to increase the creeping distance between the fixed contacts. With such a simple structure, the vehicle switch can suppress degradation of insulation characteristics between the fixed contacts, whereby the electrical connections between the fixed contacts are properly established or cut-off.

5 Claims, 7 Drawing Sheets

SWITCH FOR VEHICLE

FIELD OF THE INVENTION

The present invention relates to a switch mainly fixed to a vehicle to detect the opening/closing of a vehicle door.

BACKGROUND ART

In recent years, a car often includes a switch fixed at a car body side of a door section so as to detect the opening/closing of a door. A signal detected by the switch is used for turning ON or OFF the room light, locking or unlocking doors, or the like. Such a detecting switch is also used for controlling highly advanced security systems, for example, known as the keyless entry system. Here will be described a conventional switch for a vehicle with reference to FIGS. 7 and 8.

FIG. 7 is a sectional view of a conventional switch for a vehicle (hereinafter, referred to as a vehicle switch), and FIG. 8 is an exploded perspective view of the vehicle switch. Insulating resin case 21 has a box-like structure in which the top surface is open. Operation component 22 includes generally cylindrical-shaped operation head 22A in the upper section. Operation component 22 is housed in case 21 so as to be movable in the vertical direction. Substrate 23 is made of insulating resin and formed into a flat plate. On both surfaces of substrate 23, a plurality of wiring patterns (not shown) are formed and then a resistance element and other electronic components are mounted thereon. In addition, on the right surface of substrate 23 as seen in FIG. 7, fixed contacts 24A and 24B made of metal are oppositely disposed so as to be substantially parallel to the moving direction of operation component 22.

Fixed contacts 24A and 24B are connected via the wiring patterns to a plurality of terminals 25, and terminals 25 are fixed in the lower section of substrate 23. Substrate 23 is accommodated in case 21, with the bottom end being held by holder 26. Movable piece 27 is made of a metallic thin plate and is substantially U-shaped. The bottom and one arm of the "U" are held by the bottom section of operation component 22. The other arm of the "U" has contact hooks 27A and 27B at the lower end. Contact hooks 27A and 27B make contact with fixed contacts 24A and 24B, respectively.

Coil spring 28 is assembled between the inner bottom of case 21 and the bottom of operation component 22 under a slight initial compression to urge component 22 upwardly. Mounting plate 29 is made of a steel plate. Case 21 is fixed to the left side of mounting plate 29, and on the right side of plate 29, mounting hole 29A is disposed. Waterproof cover 30, which is made of rubber, thermoplastic elastomer, or the like, covers the upper surfaces of operation head 22A and mounting plate 29.

In the actual use of the vehicle switch structured as described above, terminals 25 protruding from the bottom of case 21 are connected to an electronic circuit (not shown) of a car. The switch is attached to a part of the chassis (not shown) facing an end of a door (not shown) by a screw (not shown) through mounting hole 29A.

Now will be described the workings of the vehicle switch. Contact hooks 27A and 27B, as shown in FIG. 7, make contact with fixed contacts 24A and 24B, respectively. While the electrical connection is maintained (i.e., during the ON-state), fixed contacts 24A and 24B carry, for example, a current of 1–10 mA at 12 volts d. c. via movable piece 27. When the door confronting the switch is closed, the edge of the closed door pushes operation head 22A covered with waterproof cover 30. Operation component 22 moves downwardly and compresses coil spring 28. By the downward movement, contact hooks 27A and 27B also downwardly slide on fixed contacts 24A and 24B, respectively, and contact hook 27B leaves from fixed contact 24B. At this moment, the electrical connections between fixed contacts 24A and 24B are broken (i.e., the fixed contacts are in the OFF-state). The signal indicating the OFF-state between contacts 24A and 24B is sent to the electronic circuit of the car, so that each component carries out an operation that should be done in the OFF-state, namely turning OFF the room light, enabling the automatic door lock system, a burglar alarm system, etc.

When the door gets opened, the edge of the door leaves operation head 22A, and accordingly, operation component 22 urged by coil spring 28 moves upwardly. The upward movement brings movable piece 27 up, so that the contact hooks of movable piece 27 make contact with corresponding fixed contacts, i.e., the contacts are in the ON-state, as shown in FIG. 7. The signal thus indicating the ON-state is sent to the electronic circuit of the car, so that the room light is turned ON, and other related components carry out each predetermined operation. Such a vehicle switch having the structure and behavior as described above is disclosed, for example, in Japanese Patent Application Non-Examined Publication No. 2003-132761.

In the conventional vehicle switch described above, the ON/OFF-states of the electrical connections of fixed contacts 24A and 24B are established by the sliding movement of movable piece 27. As contact hooks 27A, 27B are repeatedly rubbed against fixed contacts 24A, 24B over and over again, metallic abrasion powders of contact hooks 27A, 27B and fixed contacts 24A, 24B tend to accumulate between fixed contacts 24A and 24B. Besides, the distance between fixed contacts 24A and 24B is short and the surface is flat. If substrate 24 becomes wet as water accidentally comes into case 21, the structure cannot maintain satisfactory insulation characteristics between fixed contacts 24A and 24B.

SUMMARY OF THE INVENTION

The vehicle switch of the present invention contains a substrate having a plurality of fixed contacts, and a movable piece having contact sections that correspondingly make contact with the fixed contacts. The fixed contacts are oppositely disposed on the substrate so as to be substantially parallel to the moving direction of the movable piece. A barrier constituted by, a dent or a projection is disposed between the fixed contacts. Forming a dent or a projection increases the creeping distance between the fixed contacts. By virtue of the structure, degradation of insulation characteristics between the fixed contacts can be minimized, even in the case that metal abrasion powders accumulate between the fixed contacts, or in the case that the substrate becomes wet because of accidental intrusion of water. That is, a switch with reliable electrical connections can be obtained.

DETAILED DESCRIPTION OF THE INVENTION

Exemplary Embodiment

Figure 1:
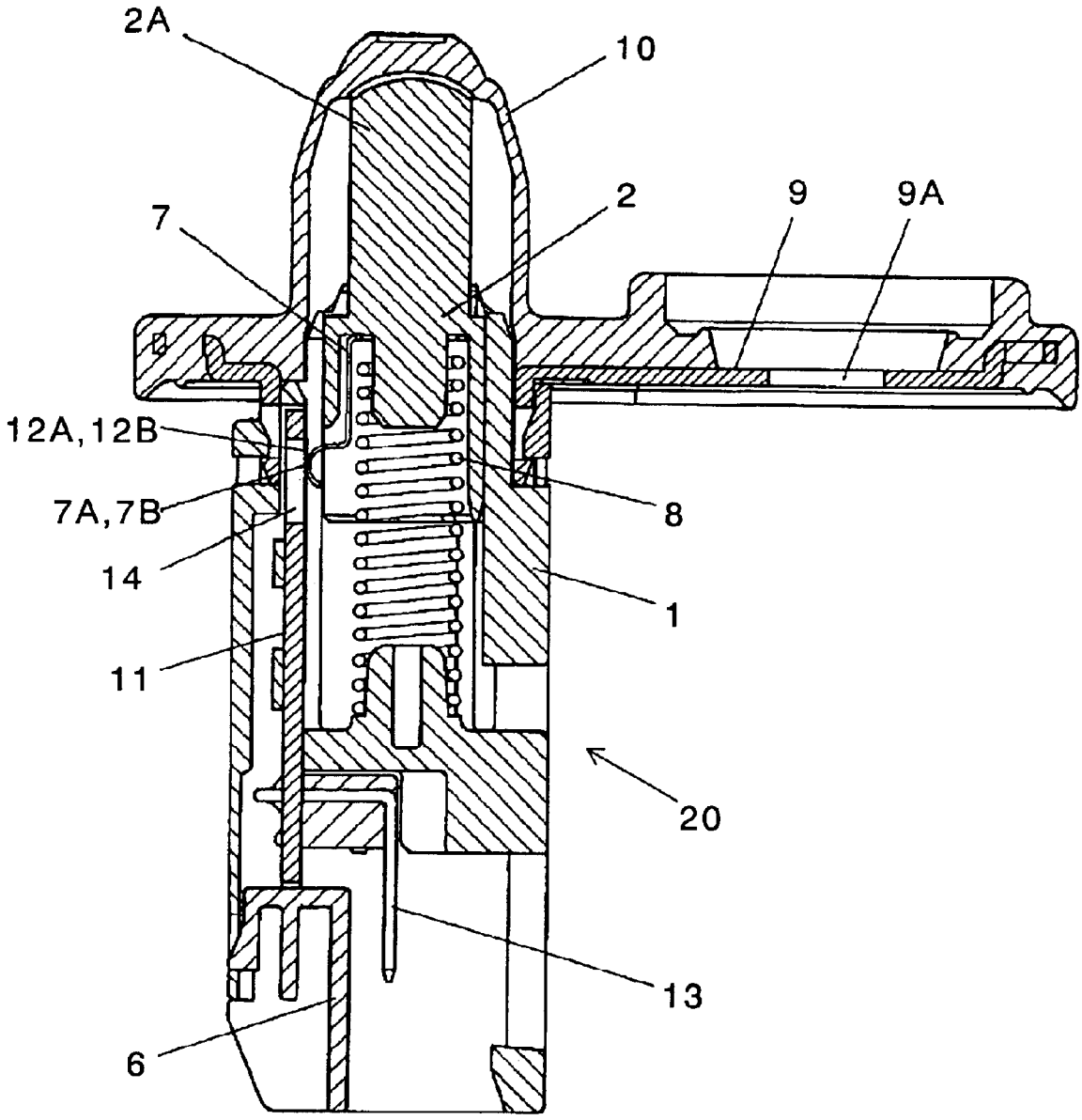
FIG. 1 is a sectional view of a vehicle switch of an exemplary embodiment of the present invention.
Figure 2:
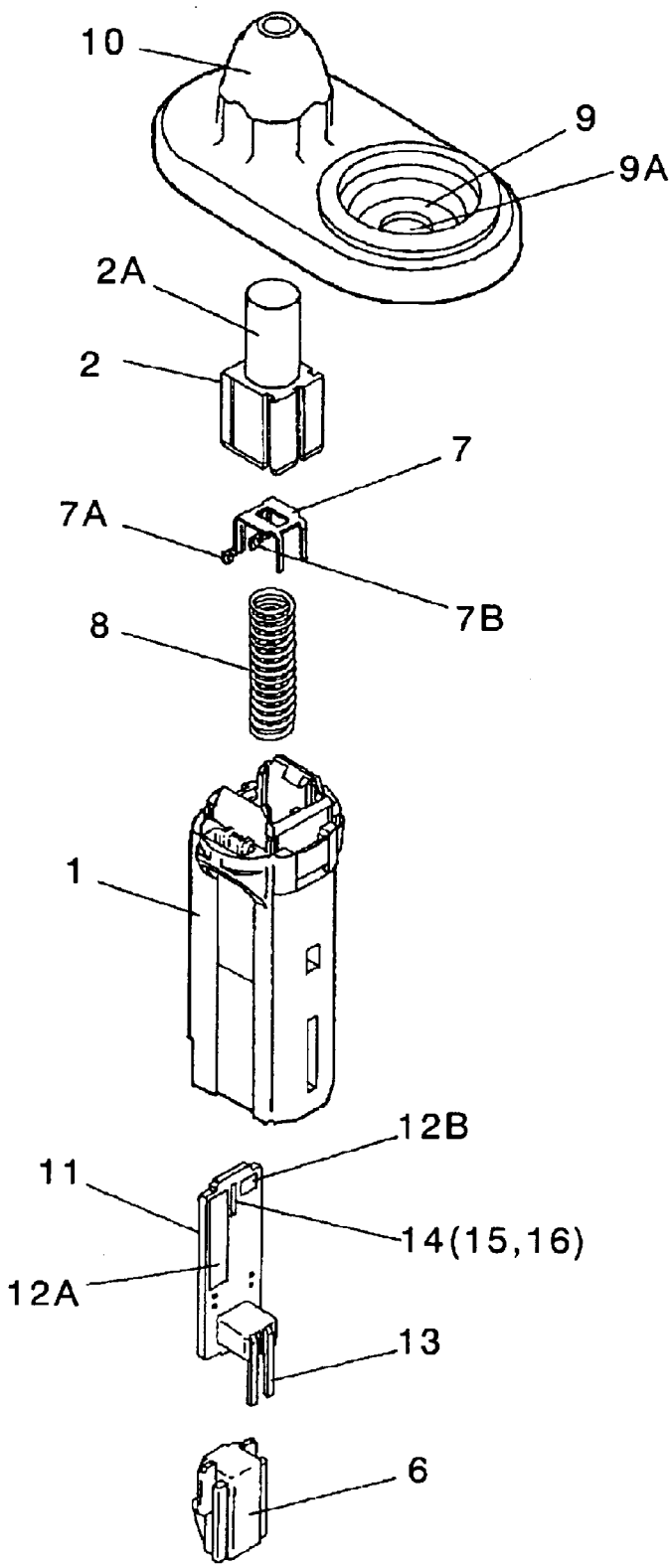
FIG. 2 is an exploded perspective view of the switch shown in FIG. 1.

FIG. 1 is a sectional view of a vehicle switch of an exemplary embodiment of the present invention, and FIG. 2 is an exploded perspective view of the switch. Insulating resin case 1 has a box-like structure in which the top surface is open. Operation component 2 includes generally cylindrical-shaped operation head 2A in the upper section. Operation component 2 is housed in case 1 so as to be movable in the vertical direction. Substrate 11 is made of insulating resin and formed into a flat plate. On both surfaces of substrate 11, a plurality of wiring patterns (not shown) are formed and then a resistance element and other electronic components are mounted thereon. In addition, on the right surface of substrate 11 as seen in FIG. 1, fixed contacts 12A and 12B are oppositely disposed so as to be substantially parallel to the moving direction of operation component 2.

Fixed contacts 12A and 12B are connected via the wiring patterns to a plurality of terminals 13, and terminals 13 are fixed in the lower section of substrate 11. Substrate 11 is accommodated in case 1, with the bottom end being held by holder 6. Movable piece 7 is made of a metallic thin plate and is substantially U-shaped. The bottom and one arm of the "U" are held by the bottom section of operation component 2. The other arm of the "U" has contact hooks (contact sections) 7A and 7B at the lower end. Contact hooks 7A and 7B make contact with fixed contacts 12A and 12B, respectively. Fixed contact 12A has a length larger than fixed contact 12B in the moving direction of operation component 2. Slit 14 is disposed at about the midpoint position between fixed contacts 12A and 12B. Slit 14 is so formed that both ends of the slit exceed outwardly the upper and the lower ends of fixed contact 12B.

Coil spring 8 is assembled between the inner bottom of case 1 and the bottom of operation component 2, under a slight initial compression, to urge component 2 upwardly, i.e., in the direction away from substrate 11. Mounting plate 9 is made of steel plate. Case 1 is fixed to the left side of mounting plate 9, and mounting hole 9A is disposed on the right side of plate 9. Waterproof cover 10, which is made of flexible resin such as rubber or thermoplastic elastomer, covers the upper surfaces of operation head 2A and mounting plate 9. In the actual use of vehicle switch (hereinafter, switch) 20 structured as described above, terminals 13 protruding from the bottom of case 1 are connected to an electronic circuit (not shown) of a car. Fixed contact 12B is to be connected on the side of the electric power supply of the electronic circuit of the car; on the other hand, fixed contact 12A is to be connected on the ground side of the electronic circuit.

Figure 6:
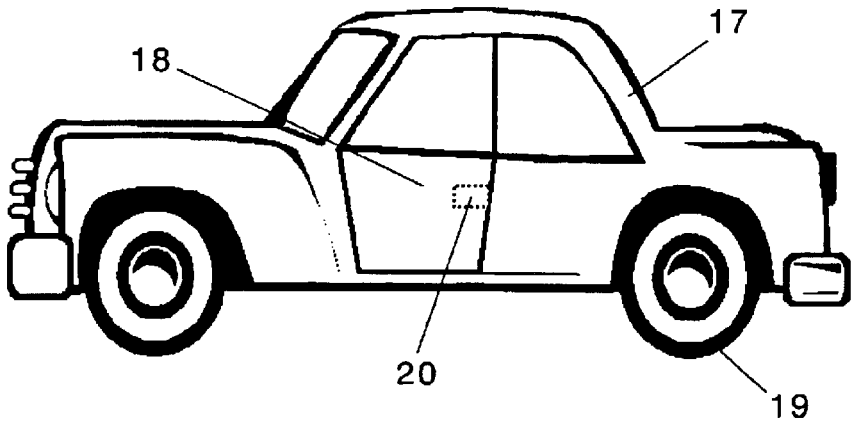
FIG. 6 is a general view of a car on which the vehicle switch of the embodiment of the present invention is mounted.
Figure 7:
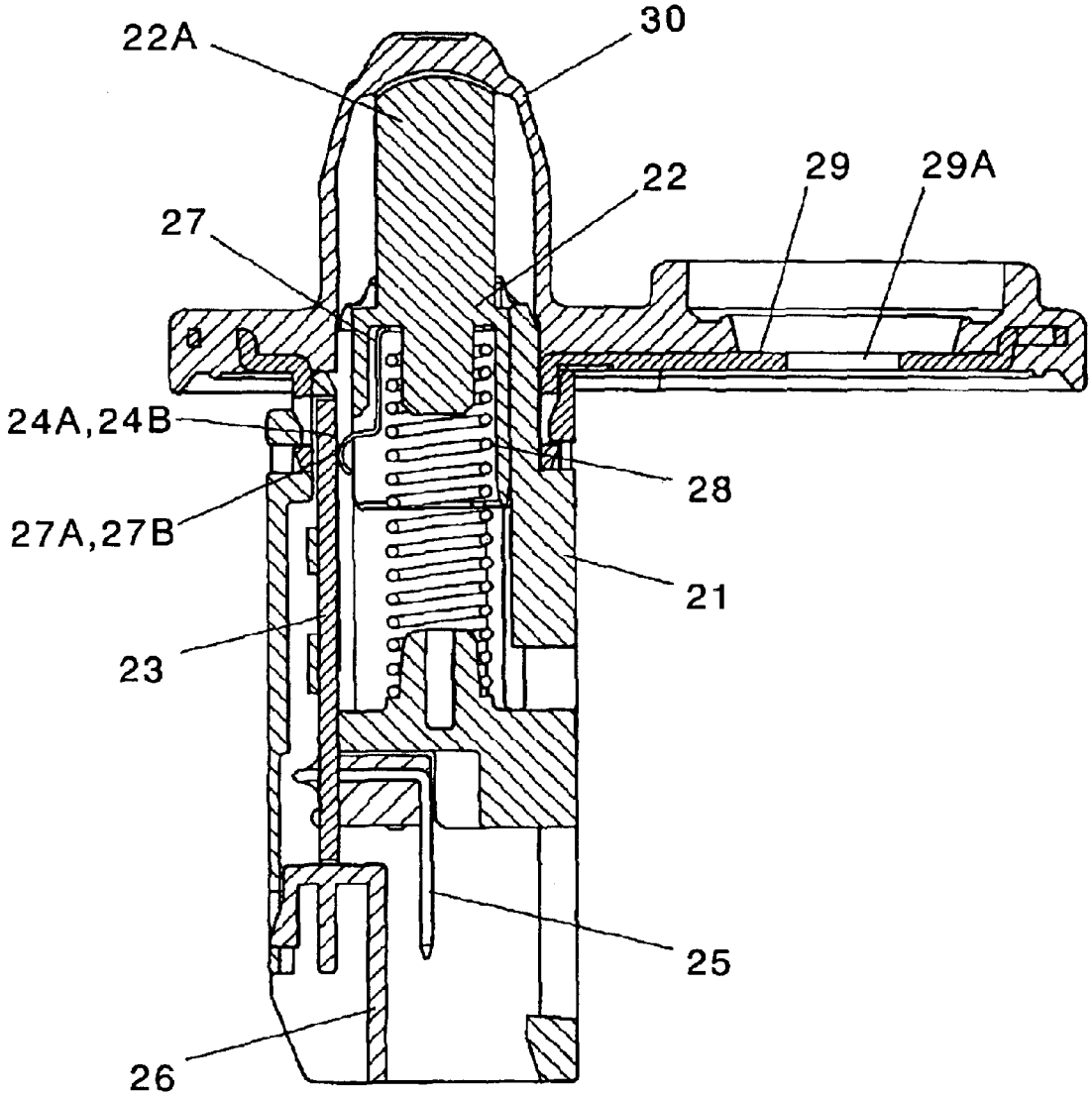
FIG.7 PRIOR ART
FIG. 7 is a sectional view of a conventional vehicle switch.
Figure 8:
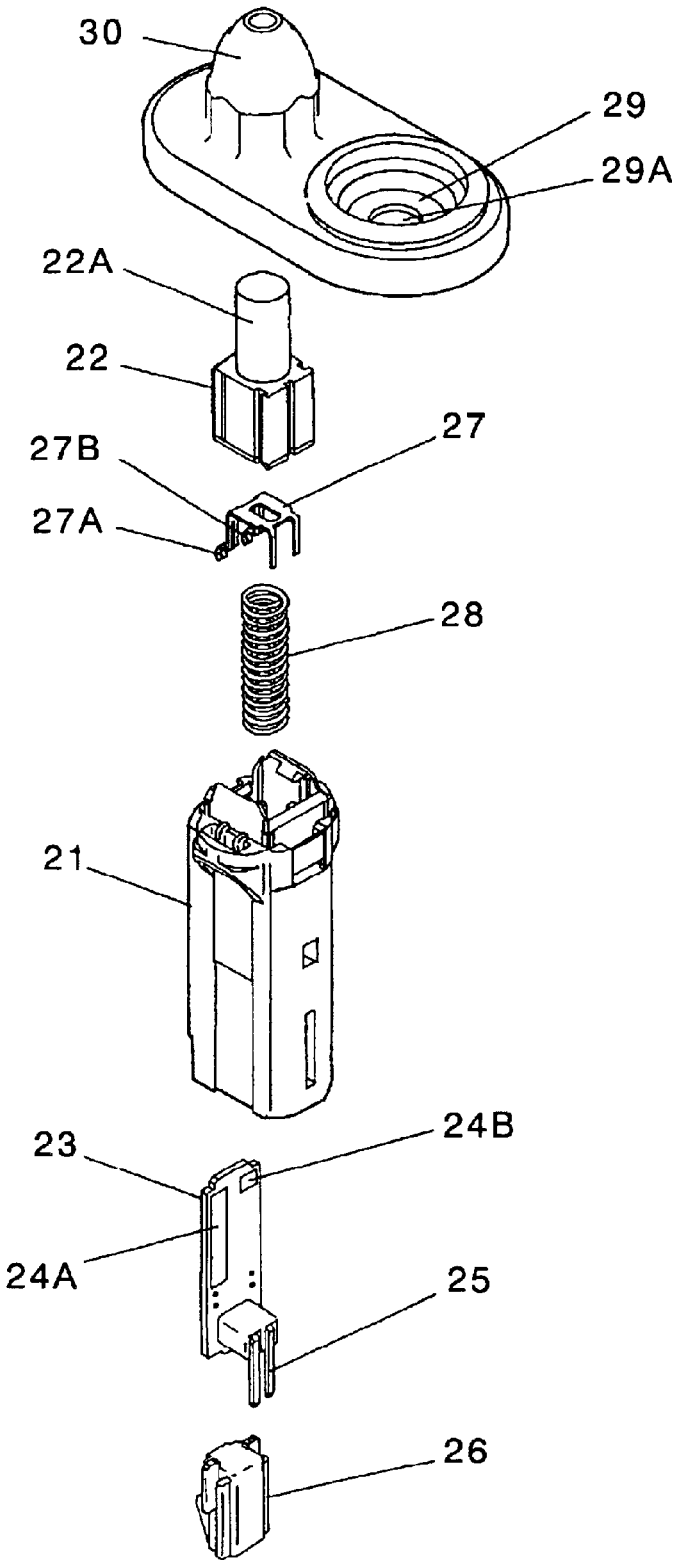
FIG.8 PRIOR ART
FIG. 8 is an exploded perspective view of the conventional switch shown in FIG. 7.

FIG. 6 shows an illustration of a car on which switch 20 is mounted on a part of car body 17 facing door 18. Car body 17 is held by driving wheels 19 that are driven by an engine or a motor (not shown). Switch 20 is attached to a part of the chassis (not shown) of car body 17 facing an end of door 18 by a screw (not shown) through mounting hole 9A.

Figure 3:
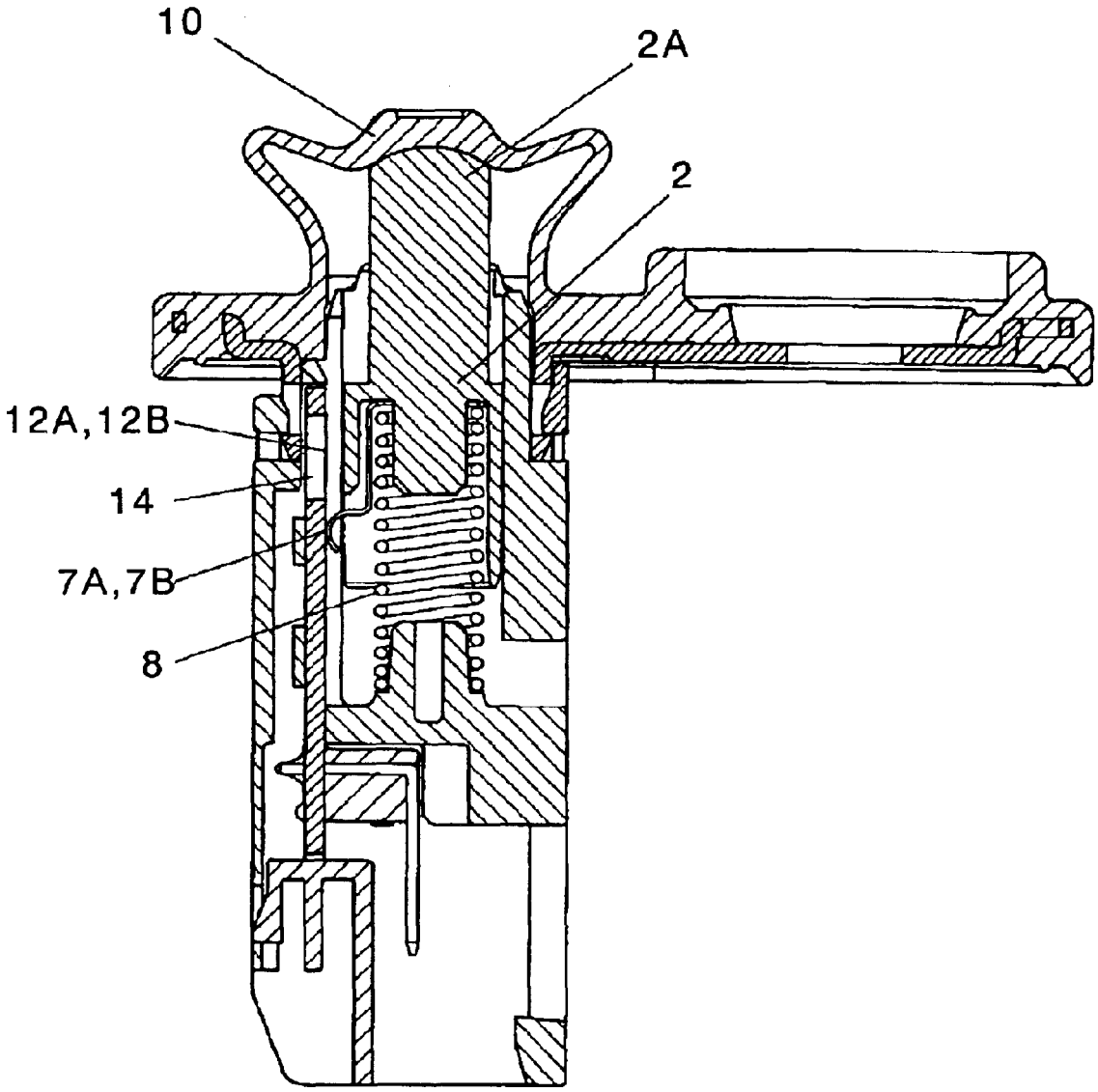
FIG. 3 is a sectional view of the switch shown in FIG. 1 in operation.
Figure 4A:
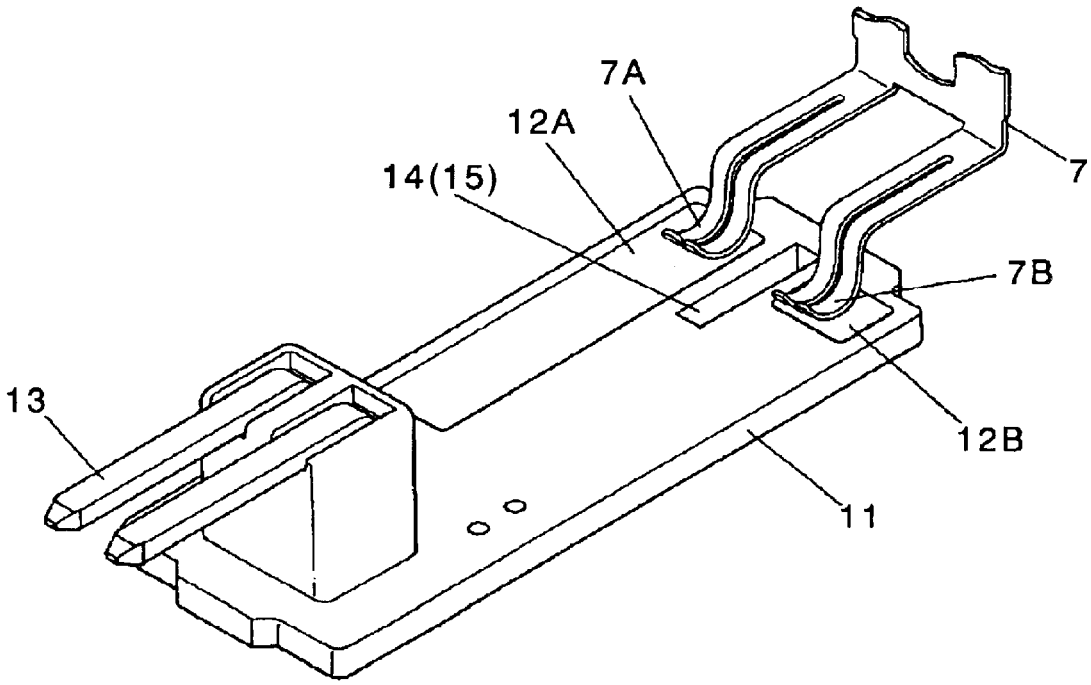
FIG. 4A and FIG. 4B are perspective views of the essential part of the vehicle switch shown in FIG. 1.
Figure 4B:
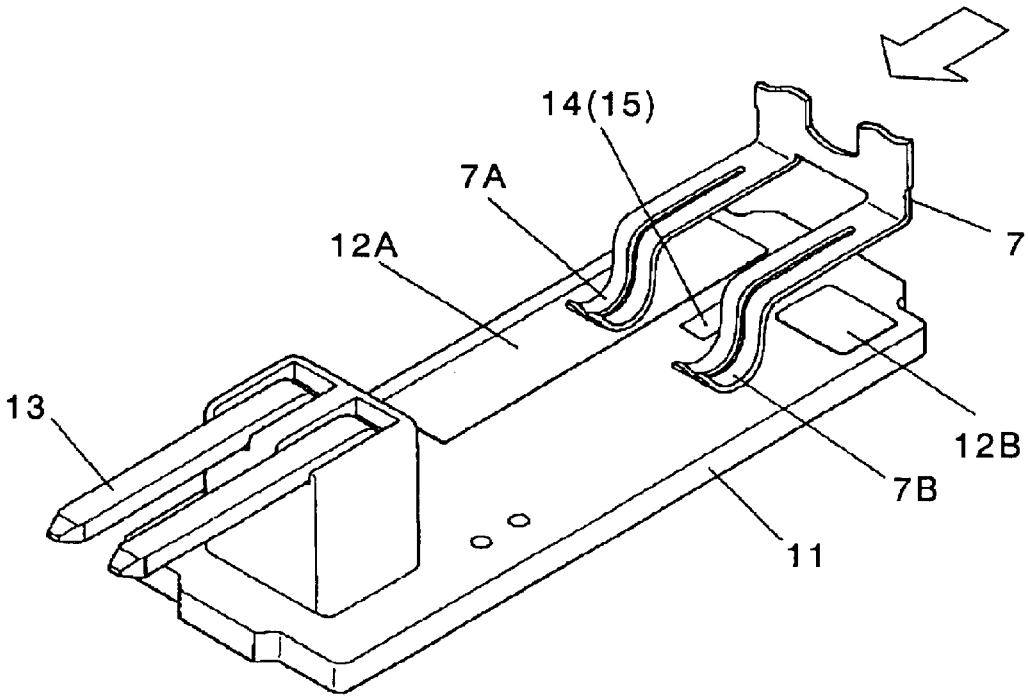

Hereinafter will be described the workings of switch 20 with reference to FIGS. 1 through 4 and FIG. 6. Contact hooks 7A and 7B make contact with fixed contacts 12A and 12B in a resilient manner, respectively. While the electrical connection is maintained (i.e., during the ON-state), fixed contacts 12A and 12B carry, for example, a current of 1–10 mA at 12 volts d. c. via movable piece 7. When door 18 is closed, the edge of door 18 pushes operation head 2A covered with waterproof cover 10 as shown in FIG. 3. Operation component 2 moves downwardly and compresses coil spring 8. By the downward movement, movable piece 7 held by operation component 2 also moves downwardly as shown in FIG. 4A, a perspective view of the essential part of the vehicle switch. As shown in FIG. 4B, contact hook 7A thus slides on fixed contacts 12A in a resilient manner, and contact hook 7B leaves from fixed contact 12B and slides on substrate 11 in a resilient manner. At this moment, the electrical connections between fixed contacts 12A and 12B are broken (i.e., the fixed contacts are in the OFF-state). The signal indicating the OFF-state between contacts 12A and 12B is sent to the electronic circuit of the car, so that the components controlled by the circuit carry out an operation that should be done in the OFF-state-turning OFF the room light, enabling the automatic door lock system, a burglar alarm system, etc.

When door 18 gets opened, the edge of door 18 leaves operation head 2A, and accordingly, operation component 2 urged by coil spring 8 moves upwardly. The upward movement brings movable piece 7 up, so that the contact hooks of movable piece 7 make contact with corresponding fixed contacts, i.e., the contacts are in the ON-state, as shown in FIG. 1. The signal thus indicating the ON-state is sent to the electronic circuit of the car, so that the room light is turned ON, and other relating components carry out each predetermined operation.

By opening or closing door 18, operation component 2 moves up or down, accordingly, the contacts of movable piece 7 make contact with fixed contacts 12A and 12B or move away from them. In this way, the ON-state and the OFF-state of electrical connections are repeated. As contact hooks 7A, 7B are repeatedly rubbed against fixed contacts 12A, 12B over and over again, metallic abrasion powders of movable piece 7 and fixed contacts 12A, 12B tend to accumulate on substrate 11 between fixed contacts 12A and 12B. At about the midpoint section between fixed contacts 12A and 12B, there is a clearance formed by slit 14. That is, the creeping distance between fixed contacts 12A and 12B is kept large enough.

As described above, slit 14 is disposed between fixed contacts 12A and 12B. Therefore, insulation characteristics between fixed contacts 12A and 12B can be properly maintained, even in the case that metallic abrasion powders accumulate between the fixed contacts. That is, a switch with reliable electrical connections can be obtained. Furthermore, even if substrate 11 becomes wet because of an accidental intrusion of water, degradation of insulation characteristics between the fixed contacts due to moisture absorption is unlikely to occur, since fixed contact 12A and 12B are separated by the clearance of slit 14. Besides, the structure can suppress a phenomenon known as migration-when a DC voltage is applied between the fixed contacts, metal atoms of one of the contacts are ionized and deposit on the other contact.

Fixed contact 12A has a length greater than fixed contact 12B. Slit 14 is so formed that both ends of the slit exceed outwardly the upper and the lower ends of fixed contact 12B. By virtue of the structure, fixed contacts 12A and 12B have a satisfactory creeping distance therebetween, even if slit 14 has a shorter length. Hence, there is little affection on strength of substrate 11.

Figure 5:
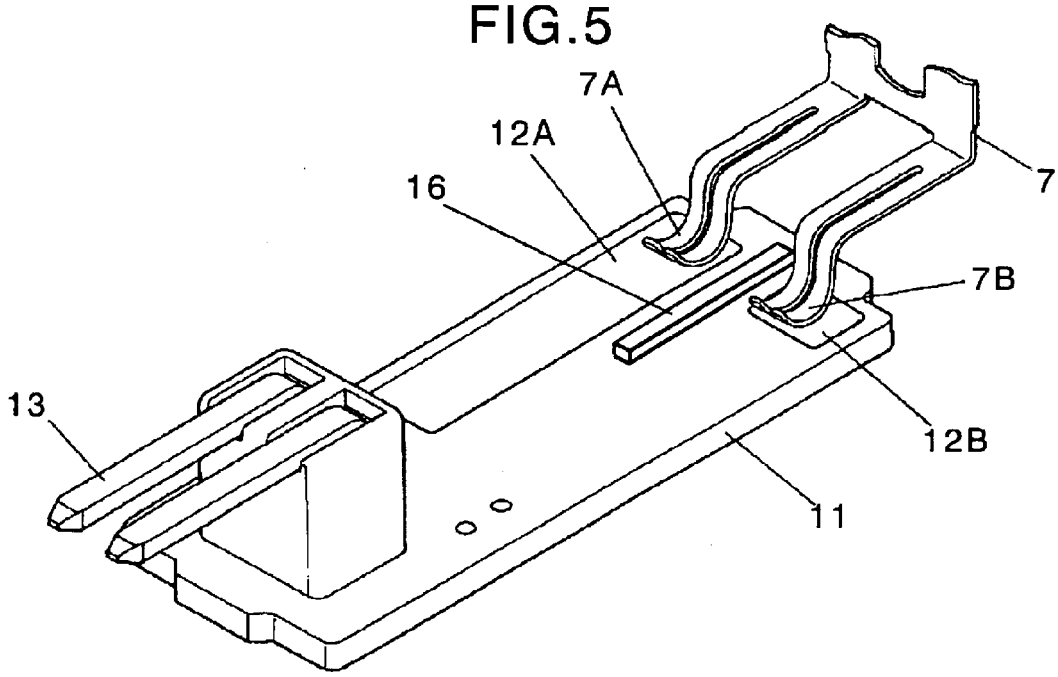
FIG. 5 is a perspective view of a switch having another structure according to the embodiment of the present invention.

Although the description above introduces the structure in which substrate 11 has slit 14 between fixed contacts 12A and 12B, it is not limited thereto; when substrate 11 is formed of insulation resin moldings, the present invention is also applicable to the substrate having a groove 15 with a predetermined depth. Furthermore, instead of a dent portion including slit 14 and groove 15, forming projection 16 between the fixed contacts 12A and 12B, as shown in FIG. 5, can offer the same effect. In this case, projection 16 should have a length and be positioned similar to slit 14.

The vehicle switch of the present invention, as described above, has a simple structure and can suppress degradation of insulation characteristics between the fixed contacts, thereby providing reliable electrical connections. The switch is therefore suitable for detecting opening/closing of a vehicle door.

What is claimed is:

1. A switch for a vehicle, comprising:

a substrate;

a movable piece movably mounted for movement relative to said substrate in a moving direction between first and second positions;

a first fixed contact and a second fixed contact disposed in parallel along said moving direction on said substrate;

wherein said movable piece includes a first contact section slidably arranged for slidable contact with said first fixed contact upon movement of said movable piece in said moving direction;

wherein said movable piece includes a second contact section slidably arranged for slidable contact with said second fixed contact upon movement of said movable piece in said moving direction;

wherein said substrate includes a barrier disposed between said first and second fixed contacts;

wherein said barrier comprises one of a dent and a projection;

wherein said first fixed contact has a greater length, in said moving direction, than said second fixed contact;

wherein said barrier has a greater length, in said moving direction, than said second fixed contact; and wherein opposing ends of said barrier both extend beyond opposing ends of said second fixed contact, respectively, along said moving direction.

2. The switch of claims 1, wherein said barrier comprises the dent, and said dent comprises one of a slit and a groove.

3. The switch for vehicles of claim 1, further comprising:

a box-shaped case made of insulating material;

an operation component housed in said case so as to be movable in said moving direction, said operation component holding said movable piece; and a coil spring disposed between said case and said operation component so as to urge said operation component in a direction away from said substrate.

4. The switch of claim 1, further comprising:

a flexible resin waterproof cover covering said case and said operation component.

5. The switch of claim 1, wherein said substrate is made of insulating material.

* * * * *